United States Patent [19]

Escaravage

[11] Patent Number: 4,848,809

[45] Date of Patent: Jul. 18, 1989

[54] LATCH, IN PARTICULAR FOR A MOTOR VEHICLE

[75] Inventor: Gerard Escaravage, Valentigney, France

[73] Assignee: Aciers et Outillage Peugeot, France

[21] Appl. No.: 101,099

[22] Filed: Sep. 25, 1987

[30] Foreign Application Priority Data

Sep. 26, 1986 [FR] France ..... 86 13492

[51] Int. Cl.[4] ..... E05C 5/02

[52] U.S. Cl. ..... 292/11; 292/201

[58] Field of Search ..... 292/11, 110, 201, 216, 292/DIG. 14, DIG. 43, 109, 144, 64

[56] References Cited

U.S. PATENT DOCUMENTS

| | | | |
|---|---|---|---|
| 3,565,476 | 2/1971 | Berman | 292/11 X |
| 3,825,295 | 7/1974 | Saunders et al. | 292/110 X |
| 3,831,580 | 8/1974 | McLean | 292/109 X |
| 4,597,598 | 7/1986 | Bascou | 292/DIG. 14 |

FOREIGN PATENT DOCUMENTS

| | | | |
|---|---|---|---|
| 56886/73 | 12/1974 | Australia | 292/10 |
| 3401842A1 | 1/1985 | Fed. Rep. of Germany . | |

*Primary Examiner*—Richard E. Moore

*Attorney, Agent, or Firm*—Sughrue, Mion, Zinn, Macpeak & Seas

[57] ABSTRACT

A latch of the type having a case (1) integral with a first part (2) of the vehicle in which is disposed a bolt (3) associated with a locking and/or unlocking mechanism (4), and a keeper (5) integral with a second part (6) of the vehicle and adapted to cooperate with the bolt, one of the first and second parts of the vehicle being movable relative to the other, and the bolt being mounted to be pivotable between a position for releasing and a position for locking the keeper. In the case, there is a shifting element (10) for shifting the keeper (5) having a hooking element (11) for hooking onto the keeper which is mounted to be movable between a keeper hooking position (A), the hooking being achieved by the user shifting the movable part of the vehicle, and a position (B) in which the bolt locks the keeper, by means of an actuator (12) controlled in one direction by a first switch indicating or detecting the presence of the keeper in the hooking position (A) and in the other direction by a second switch indicating or detecting the actuation of the means (4) for unlocking the bolt (3).

12 Claims, 1 Drawing Sheet

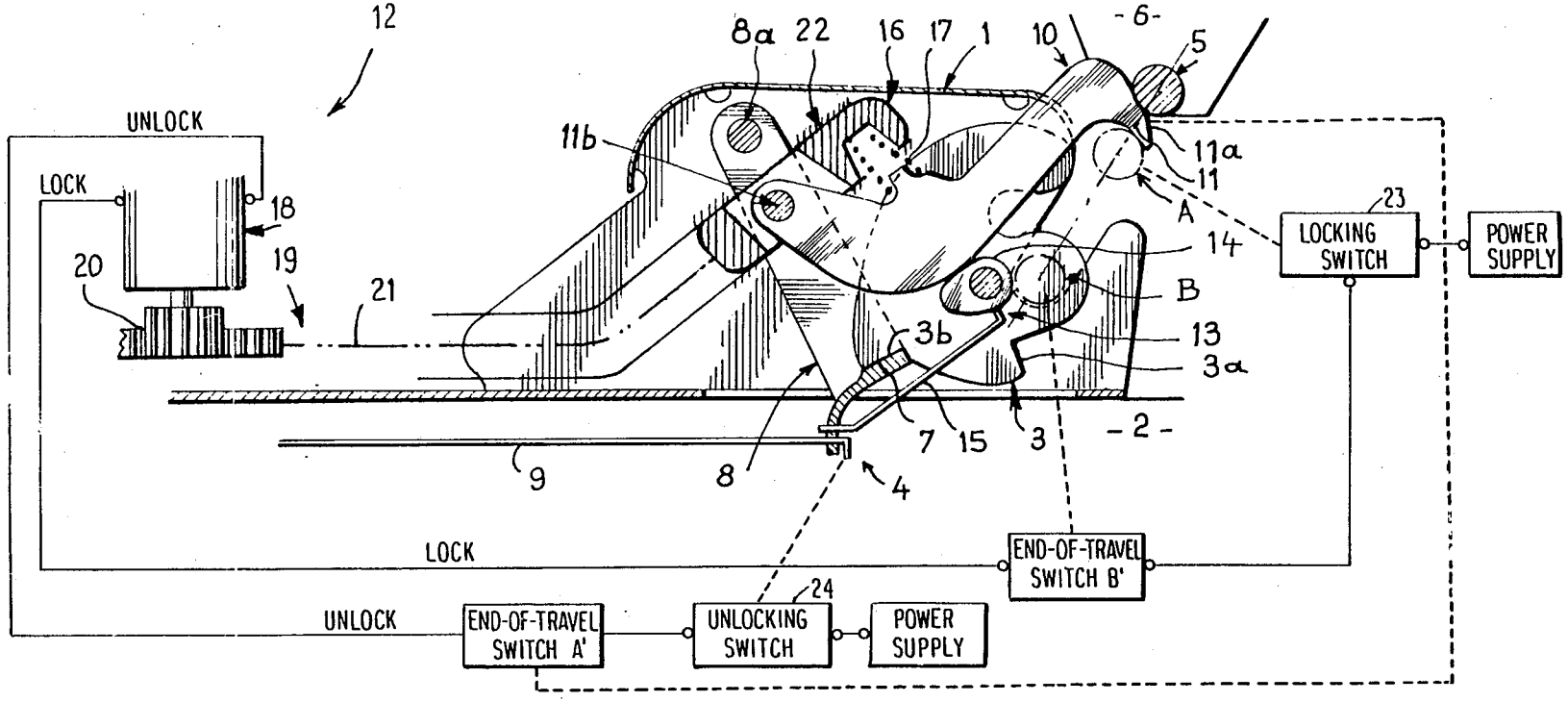
POWER SUPPLY
LOCKING SWITCH
23
END-OF-TRAVEL SWITCH B'
POWER SUPPLY
UNLOCKING SWITCH
24
END-OF-TRAVEL SWITCH A'
LOCK
UNLOCK
UNLOCK
LOCK
-6-
-2-
5
11a
11
A
14
B
13
3a
10
3
1
17
16
22
8a
15
3b
7
4
8
11b
9
12
21
18
19
20

LATCH, IN PARTICULAR FOR A MOTOR VEHICLE

Latch, in particular for a motor vehicle

The present invention relates to a latch, in particular for a motor vehicle.

More particularly, the invention concerns a latch of the type comprising a case integral with a first part of the vehicle, in which is disposed a bolt associated with locking and/or unlocking means, and a keeper integral with a second part of the vehicle, adapted to cooperate with the bolt, one of said first and second parts of the vehicle being movable relative to the other and the bolt being mounted to be pivotable between a position for releasing the keeper and a position for locking the keeper.

The latches of the prior art have a number of drawbacks, in particular as concerns the locking of the keeper by the bolt which requires a large effort resulting for example in the necessity to close the rear door of the vehicle vigorously.

An object of the invention is therefore to overcome this problem, by providing a latch which permits the keeper to be locked gently in the case while retaining the effectiveness of the locking and permitting the user to actuate at any moment the means for unlocking the keeper.

The invention therefore provides a latch of the type such as described hereinbefore, which comprises, in the case, an element for shifting the keeper comprising means for hooking onto the keeper which is mounted to be movable between a keeper hooking position, the hooking being achieved by shifting the movable part of the vehicle by the user, and a position for locking the keeper by means of the bolt, through actuating means controlled, in one direction, by means indicating the presence of the keeper in the hooking position, and, in the other direction, by means indicating the actuation of the bolt unlocking means.

Advantageously, the means for hooking onto the shifting element comprise a hook movable between an active position to which it is biased elastically and in which it extends in the path of the displacement of the keeper, and a retracted position for permitting the hooking or the release of the keeper.

A better understanding of the invention will be had from the following description, which is given solely by way of example with reference to the accompanying drawing which represents a sectional view of a latch according to the invention, the keeper being shown in several of its positions.

As shown in this Figure, a latch according to the invention for a motor vehicle comprises a case 1 integral with a first part 2 of the vehicle and in which is disposed a bolt 3 associated with locking and/or unlocking means 4. The latch further comprises a keeper 5 adopted to cooperate with the bolt and mounted on a second part 6 of the vehicle, for example mounted to be movable relative to the first part 2 of the latter.

In a known manner, the bolt is mounted to be pivotable between a keeper releasing position and a keeper locking position. The bolt has, for example, two shoulders **3*a* and 3*b*, adapted to cooperate with an abutment surface 7 of an element 8 for locking the bolt, the bolt being biased to its position for releasing the keeper by elastically yieldable means (not shown). This locking element 8 has the general shape of a U pivotally mounted at 8*a* in the case, and biased toward the bolt for defining the two positions of the latter. An actuating rod 9 permits the disengagement of the abutment surface 7 of the locking element from the shoulder 3*a*** of the bolt defining the bolt locking position, so as to release the keeper.

The latch according to the invention further comprises, disposed in the case, an element 10 for shifting the keeper 5. This shifting element comprises means 11 for hooking onto said keeper and is mounted movable, as illustrated in said Figure, between a keeper hooking position A, this hooking being achieved when the movable part of the vehicle is shifted by the user, and a position B for effecting the locking of the keeper by the bolt. This displacement is ensured by actuating means 12 controlled in one direction, i.e. from the position A for hooking the keeper 5, by the hooking means 11 of the shifting element to the position B of the locking of the keeper by the bolt, by means indicating or detecting the presence of said keeper in the hooking position, and in the other direction, i.e. from the position B of the locking of the keeper by the bolt, to the hooking position A by means indicating or detecting the actuation of the bolt locking means 4.

These indicating means are for example constituted by a locking switch 23 actuated by the keeper or the shifting element when the keeper comes into the hooking position, for the means indicating the presence of the keeper in the hooking position A, and by switch 24 actuated by said unlocking means upon their actuation for the means indicating the actuation of the bolt unlocking means.

Note furthermore that end-of-travel switches A′ and B′ in the hooking position A and the locking position B, respectively of the shifting element are provided for cutting off the supply of the actuating means 12.

The hooking means 11 of the shifting element 10 comprise a hook, movable between an active position to which it is elastically biased and in which it extends in the path of the displacement of the keeper 5, and a retracted position for permitting the hooking or the release of the keeper.

The hook has for example an inclined surface 11a with which cooperates the bolt 5 for shifting the hook to its retracted position upon the hooking of the keeper.

Further, means 13 for withdrawing the shifting element are also provided for withdrawing the latter upon actuation of the bolt unlocking means 4. These means are for example constituted by a cam 14 pivotally mounted on the bolt 3 and connected to the bolt unlocking means 4 by a shifting rod 15.

The shifting element 10 has a generally S shape. One of the ends of the latter includes hooking means 11 such as previously described, and the other end is pivotally mounted at **11*b* on a slide 16 mounted to be movable in the case 1 by the actuating means 12 so as to cause a displacement of the shifting element 10** of the keeper between the two previously-mentioned positions.

Note that the shifting element 10 is elastically biased to its active position by a spring 17 having one end bearing against the slide 16 and the other against the element 10.

The previously-mentioned actuating means 12 comprise for example a motor speed-reducer unit 18 whose output shaft cooperates with means 19 for driving the shifting element 10 for shifting the latter between its two positions. These driving means 19 comprise a gear wheel 20 integral with the output shaft of the motor speed-reducer unit 18 and adapted to cooperate with complementary shapes of a driving strip 21 which is movably mounted in a slideway 22 integral with the case 1, one end of this strip being mounted on the slide 16. Note that this slideway 22 extends between the two branches of the locking element 8. It will be undertstood that other embodiments are possible Thus, the slide may be in one piece with the strip.

Such a device operates in the following manner:

When the user shifts for example the moving part of the vehicle, on which the keeper is fixed, to the hooking position A, the keeper cooperates with the inclined surface 11*a* of the hook of the shifting element 10 and shifts the latter to its retracted position and enables the keeper to pass through the hook and reach the hooking position.

In this position, the means (locking switch 23) detecting the presence of the keeper in the hooking position supplies power to the motor speed-reducer unit 18 in a certain direction to enable the latter to displace the driving strip 21, and therefore the slide 16 and the shifting element 10, to the position B for the locking of the keeper by the bolt.

The shifting element then automatically brings the keeper 5 to the locking position B, in which the shoulder 3a of the bolt cooperates with the abutment surface 7 of the locking element 8 so as to lock the keeper in the locking position. When the keeper is in this locking position, the end-of-travel switch B′ detects this presence and cuts off the supply of the motor speed-reducer unit 18 and stops the displacement of the shifting element 10.

When the user desires to unlock the keeper, he actuates the bolt unlocking means 4 by means of the shifting rod 9, which results in a release of the bolt in the direction of its position for releasing the keeper, an actuation of the cam 14 by the rod 15 connected to the unlocking means for withdrawing the shifting element and completely releasing the keeper, and lastly a supply of power to the motor speed-reducer unit 18 in the direction opposed to the preceding direction so as to permit a rising of the shifting element to the hooking position. The end-of-travel switch A′ detects the arrival of the shifting element in the hooking position and cuts off the supply of power to the motor speed-reducer unit so as to stop the displacement of the shifting element which is then ready for another locking cycle.

In the description, the various detecting and endof-travel switches 23, 24, A′ and B′ have not been described in detail and have been only schematically illustrated in the drawing, since these types of switches are well known in the art and present no particular difficulty in use.

The shifting element 10 therefore constitutes means assisting the displacement of the keeper between a hooking position to which the keeper is brought by the user by shifting for example the movable part of the vehicle with which this keeper is integral, and a position for locking this keeper in the latch case by the bolt.

Further, as described, the user may at any moment of the locking cycle release the keeper by actuating the bolt unlocking means.

Although in the described embodiment the latch comprises a locking element, other types of latches, for example employing a passage through a dead-centre position, may be equipped with a shifting device such as that described.

What is claimed is:

1. A latch in particular for a motor vehicle having a first part and a second part, which parts are relatively movable, said latch comprising a case mounted on said first part, a keeper mounted on said second part, a bolt disposed in said case, bolt unlocking means, said keeper being cooperative with said bolt, said bolt being mounted to be pivotable between a position for releasing said keeper and a position for locking said keeper, said latch further comprising in said case a keeper shifting element including means for hooking onto said keeper and mounted to be movable between a keeper hooking position, the hooking being achieved by the user shifting the movable part of said parts of the vehicle, and a position for the locking of the keeper by said bolt, actuating means causing said shifting element to move to said position in which said keeper is locked by said bolt, means for indicating the presence of said keeper in the hooking position and for causing said actuating means to operate in a first direction and means for indicating the actuation of said bolt unlocking means and for causing operation of said actuating means in a second direction.

2. A latch according to claim 1, wherein said means for hooking said shifting element comprise a hook movable between an active position to which active position it is elastically biased and in which active position it extends into the patch of displacement of said keeper and a retracted position for permitting the hooking or release of said keeper.

3. A latch according to claim 2, wherein the hook includes an inclined surface cooperative with said keeper for shifting said hook to its retracted position when said keeper is hooked.

4. A latch according to claim 2, comprising means for retracting said shifting element when said bolt unlocking means are actuated.

5. A latch according to claim 4, wherein said shifting element retracting means comprise a cam pivotally mounted on said bolt and a shifting rod connecting said cam to said bolt unlocking means.

6. A latch according to claim 1, wherein said shifting element has a generally S shape having one end portion including said keeper hooking means and another end portion to which a slide is pivotally connected, said slide being movable in said case by said actuating means so as to cause a displacement of said shifting element for said keeper between said two positions thereof.

7. A latch according to claim 6, comprising a spring cooperative with said shifting element for biasing said shifting element to the active position thereof, said spring having one end in bearing relation to said slide and an opposite end in bearing relation to said shifting element.

8. A latch according to claim 1, wherein said actuating means comprise a motor-speed reducer unit having an output shaft and driving means for said shifting element cooperative with said output shaft for shifting said shifting element between the two positions thereof.

9. A latch according to claim 8, wherein said driving means comprise a gear wheel integral with said output shaft and a driving strip having shapes complementary to teeth of said gear wheel cooperative with said gear wheel, a slideway integral with said case, said strip being movably mounted in said slideway and having an end connected to said slide.

10. A latch according to claim 1, wherein said means indicating the presence of said keeper in the hooking position comprise a switch which is actuatable by one of two elements consisting of said keeper and said shifting element when said keeper reaches the hooking position.

11. A latch according to claim 1, wherein said means indicating the actuation of said bolt unlocking means comprise a switch actuatable by said bolt unlocking means when said bolt unlocking means are actuated.

12. A latch according to claim 1, comprising end-of-travel switches associated with said shifting element in the hooking and locking positions thereof for cutting off the supply of power to said actuating means.

* * * * *